US005810410A

United States Patent [19]

Arterbury et al.

[11] Patent Number: 5,810,410

[45] Date of Patent: Sep. 22, 1998

[54] COMBINED WASHOVER AND RETRIEVAL DEVICE

[75] Inventors: Roy S. Arterbury; Thomas C. Burroughs, both of Houston, Tex.

[73] Assignee: The Cavins Corporation

[21] Appl. No.: 587,465

[22] Filed: Jan. 17, 1996

[51] Int. Cl.[6] ..... E21B 31/03

[52] U.S. Cl. ..... 294/86.34; 294/86.17; 294/86.33

[58] Field of Search ..... 294/86.1, 86.12, 294/86.15, 86.18, 86.2, 86.21, 86.26, 86.3, 86.33, 86.34; 166/98, 99

[56] References Cited

U.S. PATENT DOCUMENTS

| | | | |
|---|---|---|---|
| 1,751,998 | 3/1930 | Hinderliter | 294/86.12 |
| 2,647,008 | 7/1953 | Stewart et al. | 294/86.34 |
| 2,762,438 | 9/1956 | Naylor | 294/86.34 |
| 2,947,362 | 8/1960 | Smith | 294/86.34 |
| 3,131,762 | 5/1964 | Dye | 294/86.34 |
| 3,352,593 | 11/1967 | Webb | 294/86.34 X |
| 3,785,690 | 1/1974 | Hutchinson | 294/86.34 |
| 4,696,502 | 9/1987 | Desai | 294/86.34 X |

*Primary Examiner*—Johnny D. Cherry
*Attorney, Agent, or Firm*—Bush, Riddle & Jackson

[57] ABSTRACT

A combined washover and retrieval device (30, 30A) for connection to the lower end of a tubular string (14, 14A) including an outer washover pipe (22, 22A) and an inner retrieval tool (36, 36A). Retrieval tool (36, 36A) includes an upper sub (30, 30A) secured at its upper end to a tubular support (23, 23A). In a preferred embodiment of FIG. 1–3, the sub (30) has a plurality of ports (35) to permit the upward flow of fluid with entrained soil and debris through the inner annulus (38) and ports (35) at the upper end of the annulus (38) to bypass the retrieval tool (36). Another embodiment illustrated in FIGS. 4–7 has a plurality of shear pins (31A) connecting the washover pipe (22A) to the sub (30A). Pins (31A) are sheared upon washover pipe (22A) abutting the packer (16A) under a predetermined weight from the tubing string (14A) to permit downward relative movement of retrieval tool (36A) for connection to the fish (18A).

10 Claims, 3 Drawing Sheets

COMBINED WASHOVER AND RETRIEVAL DEVICE

FIELD OF THE INVENTION

This invention relates to a retrieval device for retrieving an object or obstruction, such as a packer, bridge plug, or stuck tool (fish) from within a well bore. More particularly, the invention relates to such a washover and retrieval device in which a retrieval tool is combined with a washover pipe to clean sand and debris from around a fishing neck prior to connection of the retrieval tool to the fishing neck.

BACKGROUND OF THE INVENTION

It is a common practice during drilling, completion, and washover operations to recover objects from the inside of an oil or gas well. Some objects, such as bridge plugs and packers, are purposely placed within a wellbore and designed to be retrieved after a certain service such as well fracturing, for example, has been performed. A retrieving tool is usually run in on the lower end of a tubing sting to receive and latch onto a fishing neck of the bridge plug or packer. After attaching, the bridge plug or packer is released and pulled out of the well. This operation may be difficult or impossible if sand or debris has collected around and atop the fishing neck of a bridge plug or packer.

Well fluids are normally circulated through the lower end of the retrieving tool with a surface pump or a bailing tool to attempt to clean out sand and debris during the retrieving operation. A problem exists when the retrieving tool engages the fishing neck and sand and debris is still in place around the fishing neck below the lower end of the retrieving tool. This sand may not be removed by circulation due to the close fit between the inside diameter of the retrieving tool and the outside diameter of the fishing neck. As much as two (2) to four (4) feet of sand may be left atop the bridge plug or packer after the retrieving tool has engaged onto the fishing neck. Since bridge plugs and packers are large diameter tools, they usually may not be pulled out of the hole if sand is on top of them. Therefore, most retrieving jobs require two steps. First, a large diameter basket or shoe is run in the hole on the lower end of tubing to swallow the entire length of the fishing neck. Well fluid is circulated by using a surface pump or bailing tool to clean out any sand and debris from atop and around the fishing neck. After cleaning out the sand and debris, the large diameter shoe and tubing are pulled out of the hole. The second step is running the tubing and the retrieving tool back into the well to latch onto and retrieve the bridge plug or packer plug. If formation sand or debris sluffs into the well and collects above and around the fishing neck during the interval of time between steps one and two, the retrieving step will usually be unsuccessful and step one will have to be repeated. This whole process may take two (2) to three (3) days to complete in an offshore application. Each time the drill pipe is required to be run in and out of the well is time consuming and expensive.

U.S. Pat No. 3,785,690 dated Jan. 15, 1974 shows a retrieval tool having a washover pipe with an annular cutting surface at its lower end for removing obstructions about the fish such as sand and debris. The soil and debris is removed by fluid flowing down through the pipe string and then upwardly through the annulus outside the washover pipe. The size of the material being removed is restricted by the width of the annulus. The retrieval tool is moved downwardly relative to the washover pipe for connection to the fish for removal of the fish from the well bore.

A need exists for a tool that can completely clean off sand and debris atop a packer or bridge plug and simultaneously attach onto its fishing neck. Such a device would also be desirable when attempting to remove any object that is stuck in a well due to being surrounded by sand and debris.

SUMMARY OF THE INVENTION

The present invention is particularly directed to a combined washover and retrieving device which is effective in a single trip to clean out the bore above an obstruction in the well, such as a bridge plug or packer, and to attach to a fishing neck for retrieval of the obstruction. The combined washover and retrieving device or tool is connected to the lower end of the tubing or drill pipe and is lowered into the bore hole in a concentric relation to the outer casing until sand and debris is encountered within the bore hole over a packer or bridge plug. An outer annulus is formed between the casing and the tool. A washover pipe of the device extends about the retrieval tool and forms an inner annulus between the washover pipe and retrieval tool. A sub is connected to the upper end of the washover pipe at a location above the retrieval tool and has transverse ports or openings communicating with the bore of the tool string to permit the upward flow of fluid in the inner annulus to bypass the retrieval tool.

Fluid flows downwardly in the outer annulus between the washover pipe and casing for washing out sand and debris over a packer or bridge plug, then flows upwardly with the entrained sand and debris within the washover pipe and inner annulus, and next flows through the ports in the sub and upwardly through the pipe string bore bypassing the retrieval tool below the ports in the sub. The length of the washover pipe relative to the retrieval tool is designed so that the retrieval tool engages the fish or fishing neck when the end of the washover pipe is about one (1) to two (2) inches above the packer or bridge plug thereby permitting a continuous wash operation during connection of the retrieval tool to the fishing neck. The tool string may then be pulled from the well bore with the fish held by the retrieval tool.

In one embodiment, the retrieval tool is connected by shear pins to the washover pipe. The washover pipe is effective in removing the sand and debris from over the packer and after such removal, the washover pipe abuts the packer or bridge plug under a predetermined weight exerted against the tool string for shearing the shear pins. Then, the retrieval tool moves downwardly relative to the washover pipe for engaging the fishing neck for removal of a packer or bridge plug, for example.

Other features and advantages of this invention will be apparent from the following specification and drawings.

DESCRIPTION OF THE INVENTION

EMBODIMENT OF FIGS. 1–3

Figure 1:
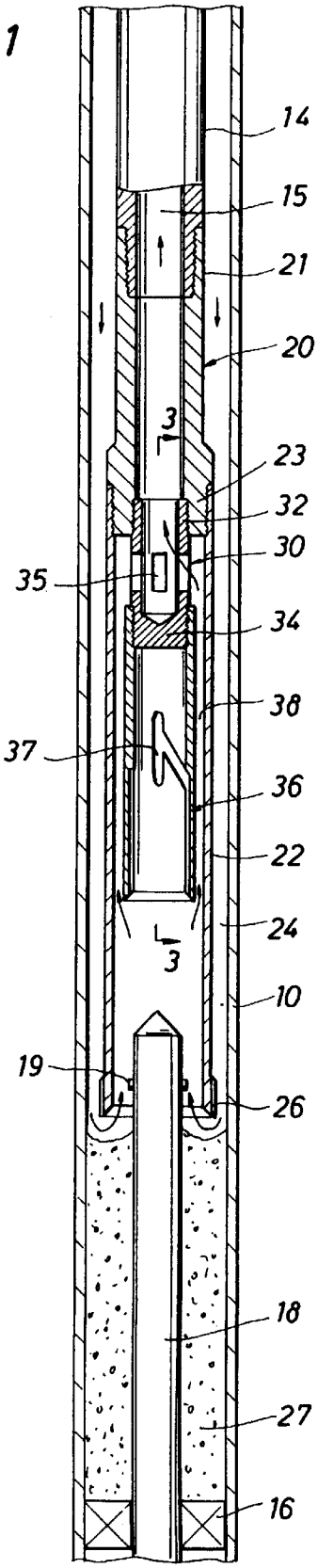
FIG. 1 is a longitudinal sectional view of a preferred embodiment of the invention in which a washover and retrieval device is connected to the lower end of a tubular work string and lowered within a well bore above a packer for cleaning sand and debris off the packer.
Figure 2:
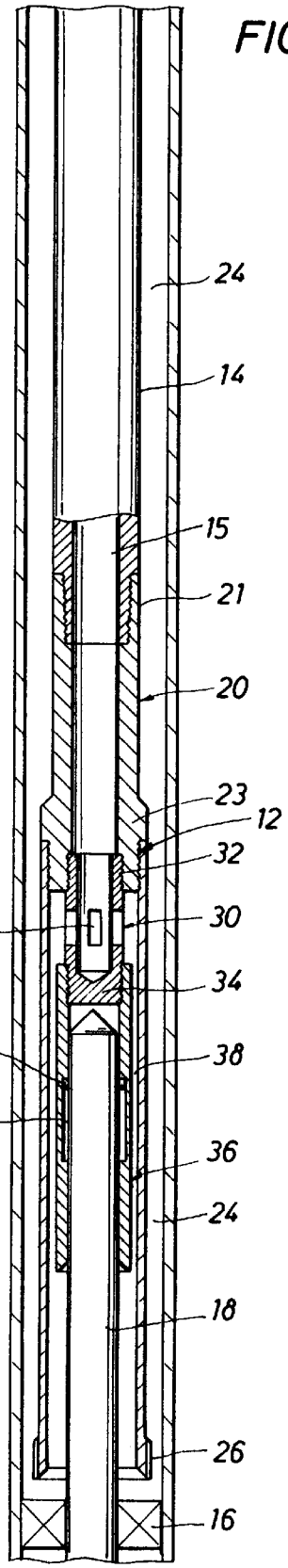
FIG. 2 is a view similar to FIG. 1 but showing the washover shoe spaced above the packer about two (2) inches with the retrieval tool in engagement with a fish for removal of the fish.
Figure 3:
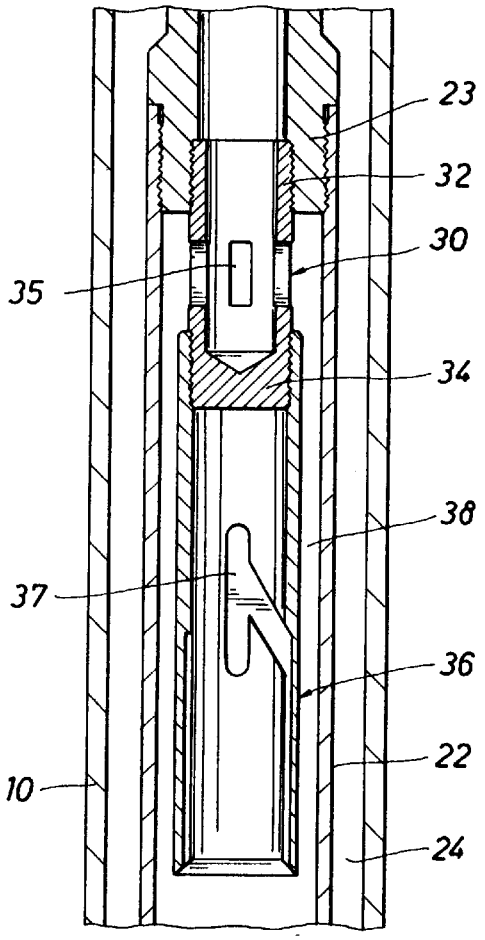
FIG. 3 is an enlarged fragment of FIG. 1 showing a sub in the work string above the retrieval tool with transverse ports in the sub communicating with the bore of the work string.
Figure 6:
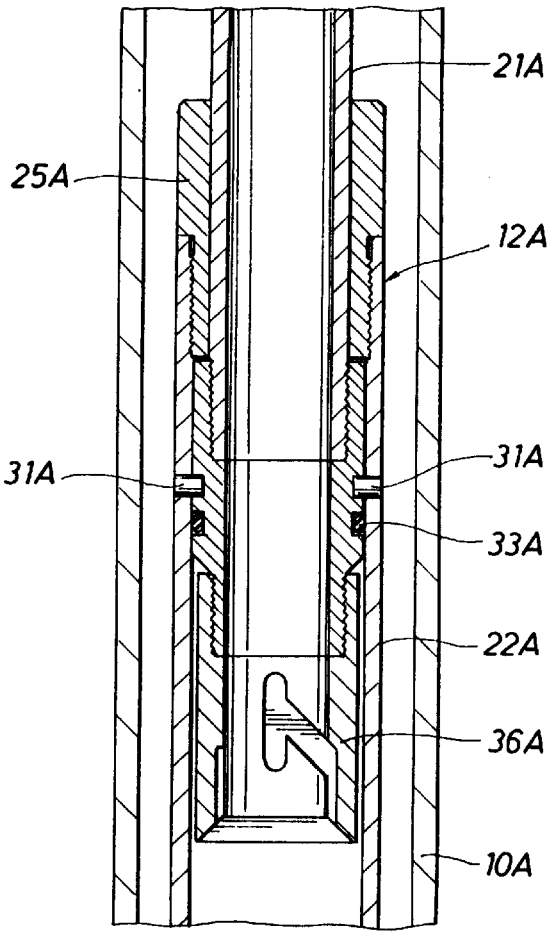
FIG. 6 is an enlarged fragment taken generally along line 6—6 of FIG. 4 showing the connection of the washover pipe and retrieval tool.
Figure 7:
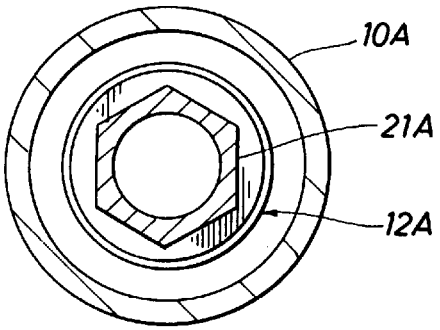
FIG. 7 is a section taken generally along line 7—7 of FIG. 5 showing a kelly connected to the retrieval tool and effecting rotation of the washover pipe after separation of the retrieval tool.

Referring now to the preferred embodiment of the invention shown in FIGS. 1–3, an outer casing 10 lines the well bore hole and a combined washover and retrieval device generally indicated at 12 is connected to the lower end of a tubing string 14 for lowering within casing 10. Tubing string 14 has a central bore 15.

A packer 16 is mounted within casing 10 and a fishing neck 18 secured to packer 16 extends upwardly within the bore. Sand, soil, and debris 27 has collected over packer 16 about fish or fishing neck 18 to obstruct access to fishing neck 18. Fishing neck 18 has a pair of opposed pins or lugs 19 for connection to a retrieval tool. The height of the sand and debris over packer 16 may be as great as four (4) feet, for example. Thus, a washover operation is desired for removal of the sand and debris so that fishing neck 18 may be easily pulled from the well bore.

The combined washover and retrieval device 12 includes an upper tubular head or support generally indicated at 20 threaded at its upper end 21 onto the lower end of tubing string 14. An outer washover pipe 22 is threaded at its upper end onto the lower end 23 of upper tubular support 20 and an outer annulus 24 is defined between casing 10 and washover pipe 22. Washover pipe 22 has a lower guide shoe 26 which may, if desired, be provided with teeth for removal of the sand and debris 27 above packer 16.

A sub generally indicated at 30 has an upper end 32 externally threaded and secured to the lower internally threaded end 23 of upper tubular support 20. Sub 30 has a closed bottom 34 and a plurality of transverse ports 35 extend through the wall of sub 30 to bore 15 of tubing string 14. Threaded onto the lower end of sub 30 is a retrieval tool indicated at 36 which is a fishing type tool having J-slots 37 for connection to pins 19 of fishing neck 18 for removal of the obstruction. Retrieval tool 36 is of a predetermined shape and size to be compatible with fishing neck 18 of packer 16. Sub 30 thus forms a portion of retrieval tool 36 and may be formed integral with retrieval tool 36 in one piece if desired. Wash pipe 22 forms a shroud about sub 30 and retrieval tool 36 and defines an inner annulus 38 between the inner circumferential surface of washover pipe 22 and the outer surface of sub 30 and retrieval tool 36. Washover pipe 22 is of a predetermined length relative to the length of retrieval tool 36 so that shoe 26 is spaced about two (2) inches from packer 16 when retrieval tool 36 is in engagement with fishing neck 18. Thus, the washing operation in which fluid flows upwardly through annulus 38 and ports 35 to bypass retrieval tool 36 may continue during connection of retrieval tool 36 to fishing neck 18. Sub 30 may be formed of varying lengths to determine the location of the lower end of the shoe 26 so that a uniform length of tool 36 may be employed.

OPERATION OF EMBODIMENT OF FIGS. 1–3

In operation, for removal of sand and debris atop packer 16 prior to removal of fishing neck 18, tubing string 14 with washover and retrieval device 12 is lowered within the bore hole to a position at which lower shoe 26 of washover pipe 22 contacts the upper end of the sand and debris fill 27 above packer 16. Circulation of fluid within the well is commenced by a surface pump to circulate fluid downwardly through outer annulus 24 for contacting and entraining the sand and debris of fill 27 in the circulated fluid for upward flow within washover pipe 22 and inner annulus 38 through ports 35 and bore 15 to a surface location. The fluid entrained with the sand and debris removed from atop packer 16 bypasses retrieval tool 36 and the cleaning action continues even when retrieval tool 36 engages fishing neck 18. The length of washover pipe 22 below retrieval tool 36 is predetermined so that retrieval tool 36 engages fish 18 when washover shoe is spaced from packer 16. Lugs 19 are received within J-slots 37 as well known and upward movement of tubing string 14 removes fish 18.

Inner annulus 38 has a width or clearance generally around ⅜ inch to ⅝ inch but may be as much as one (1) inch. Thus, debris, such as "frac" balls, having a thickness greater than the width of annulus 38 would not be received within annulus 38 for bypassing retrieval tool 36. In such event, sub 30 may be modified to have an open lower end instead of closed bottom 34 to permit the removal of large size debris or balls through the bore of retrieval tool 36 and sub 30. No separate movement of retrieval tool 36 relative to washover pipe 22 is required and the cleanout operation is continued even during connection of retrieval tool 36 to fish 18.

EMBODIMENT OF FIGS. 4–7

Figure 4:
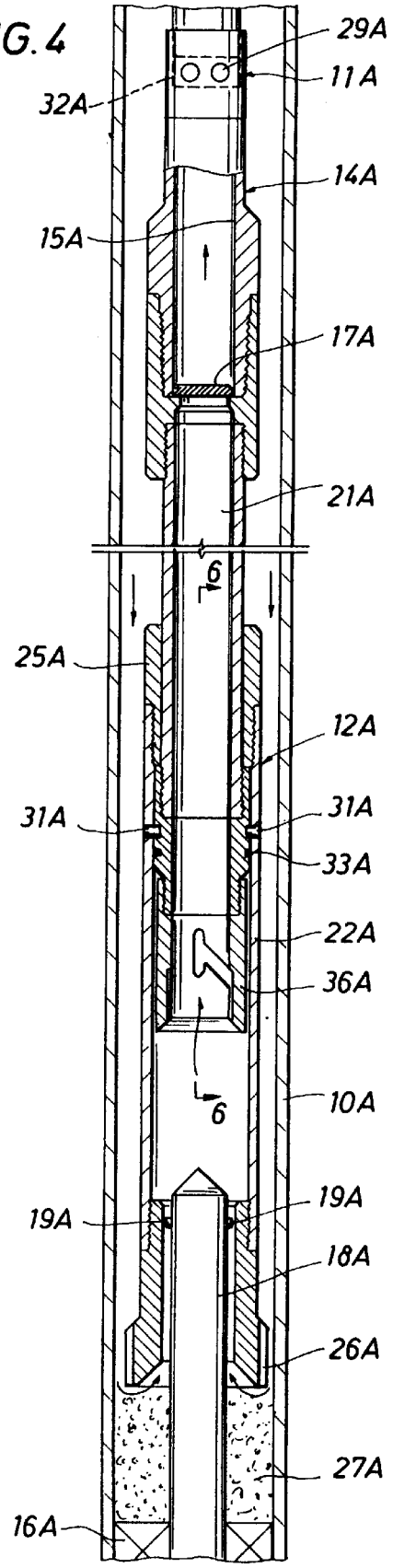
FIG. 4 is a longitudinal sectional view of a further embodiment of the invention in which a plurality of shear pins connect the outer washover pipe to the retrieval tool and the retrieval tool is spaced above the fish during cleaning of the area over the packer by the washover pipe.
Figure 5:
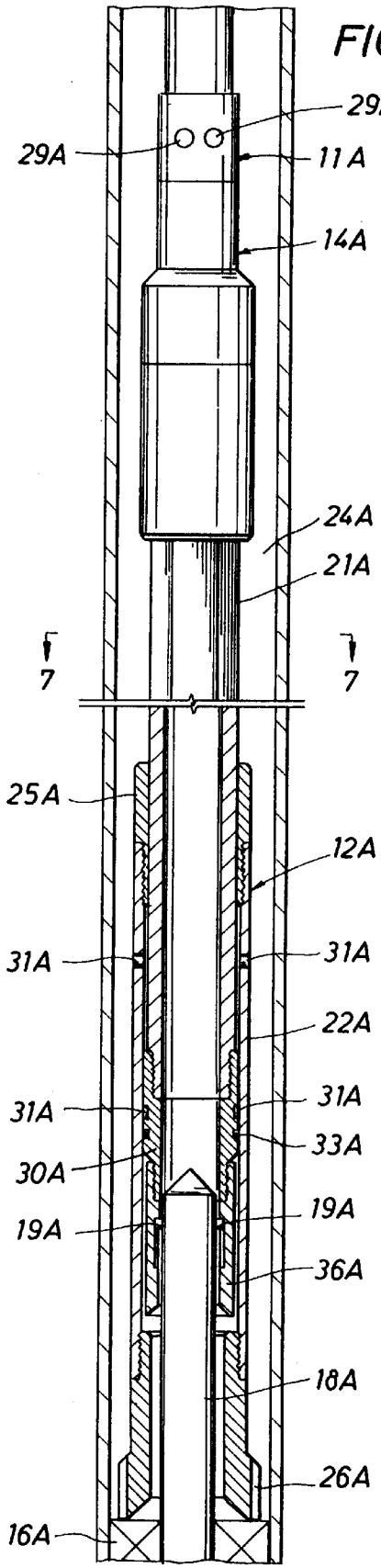
FIG. 5 is a longitudinal sectional view similar to FIG. 4 but showing the retrieval tool separated from the washover pipe upon shearing of the shear pins and engaging the fish after moving downwardly relative to the washover pipe.

Referring now to FIGS. 4–7, another embodiment of the invention is illustrated which is particularly adapted for removal of large size debris including "frac" balls. Casing 10A lines the well bore and combined washover and retrieval device generally indicated at 12A is connected to the lower end of a tubing string 14A. Tubing string 14A includes a pivoted check valve 17A and a circulation valve 11A above check valve 17A permits fluid to drain from tubing string 14A above check valve 17A as tubing string 14A is being removed from the well. Check valve 17A prevents the downward flow of fluid from tubing string 14A. Check valve 17A and circulation or drain valve 11A are normally utilized with a bailing tool which sucks debris into the tubing or drill pipe and traps it. Circulation valve 11A includes a telescoping valve member 32A closing ports 29A through the wall of tubing string 14A in a lowered position when cleaning out debris 27A, and opening ports 29A in an upper position for draining fluid from tubing string 14A above check valve 17A when check valve 17A is closed upon lifting of tubing string 14A as shown in FIG. 4. Also, the telescoping valve member 32A is in an upper position for opening ports 29A when fluid is circulated down tubing string 14A and upwardly through annulus 24A to a surface location. A suitable circulation or drain valve or valve section as illustrated at 11A is sold by The Cavins Corporation of Houston, Tex. A kelly 21A is received at its lower end within a bushing 25A for surface rotation of the washover and retrieval device 12A. A sub 30A is connected to the lower end of kelly 21A and retrieval tool 36A is connected to the lower end of sub 30A. An outer washover pipe 22A is connected by a plurality of shear pins 31A to sub 30A. An O-ring 33A is positioned between sub 30A and washover pipe 22A. Washover pipe 22A has a lower shoe 26A with projecting teeth for removal of sand and debris 27A about packer 16A. An outer annulus 24A is defined between casing 10A and washover pipe 22A.

The length of washover pipe 22A is predetermined so that packer 16A is contacted by washover pipe 22A after the cleanout operation but before retrieval tool 36A engages fishing neck 18A. Thus, the sand and debris fill 27A atop packer 16A is removed prior to contact of retrieval tool 36A with fishing neck 18A. As a result, large size debris or junk may be removed through the bore of retrieval tool 36A and bore 15A of tubing string 14A. It is to be understood that a check valve and drain valve similar to the arrangement shown in FIGS. 4 and 5 may be utilized with the embodiment shown in FIGS. 1–3.

OPERATION OF EMBODIMENT OF FIGS. 4–7

In operation, the washover and retrieval device 12A is lowered by tubing string 14A within casing 10A until lower shoe 26A on washover pipe 22A engages the sand, debris, or junk fill 27A over packer 16A Washover pipe 22A and lower shoe 26A are rotated from the surface through kelly 21A for removal of the sand, debris and small junk fill or pile indicated at 27A. Fluid is circulated downwardly through outer annulus 24A and around shoe 26A on the lower end of washover pipe 22A for entrainment of the sand and debris therein for upward flow through retrieval tool 36A and bore 15A of tubing string 14A. This operation continues until the debris pile 27A is removed from packer 16A and the lower end of shoe 26A abuts packer 16A. In this position, retrieval tool 36A remains spaced from fishing neck 18A and relatively large debris or junk can be removed from atop packer 16A as the circulating fluid with the debris moves upwardly through tool 36A while retrieval tool 36A is in a raised position removed from fishing neck 18A. After abutment of shoe 26A against packer 16A, weight is applied to tubing string 14A from the surface against packer 16A to shear pins 31A. Upon shearing of pins 31A, retrieval tool 36A and kelly 21A move downwardly relative to bushing 25A and washover pipe 22A to engage pins 19A of fishing neck 18A to be removed. Kelly 21A permits the rotation of washover pipe 22A and bushing 25A, if desired, after the shearing of shear pins 31A and separation of retrieval tool 36A.

Objects such as bridge plugs and packers are designed to be retrieved after a certain service has been performed. The retrieving tool is adapted to easily latch onto a fishing neck on a bridge plug or packer. After attaching, the bridge plug or packer is released and pulled out of the well. The present invention permits sand and debris around the fishing neck below the lower end of the retrieving tool to be easily removed prior to removal of the fish such as the bridge plug or packer. Oftentimes, bridge plug or packers can not be pulled out of the hole if the sand or debris on top of the bridge plug or packer is two (2) or three (3) feet in depth or height. Thus, it is necessary to remove such sand or debris in many instances before the bridge plug or packer can be removed.

While preferred embodiments of the present invention have been illustrated in detail, it is apparent that modifications and adaptations of the preferred embodiment will occur to those skilled in the art. However, it is to be expressly understood that such modifications and adaptations are in the spirit and scope of the present invention as set forth in the following claims.

What is claimed is:

1. A combined washover and retrieval device adapted to be connected to the lower end of a tubular string within a well bore for the removal of an obstruction within a well bore and comprising:

an outer casing lining said well bore;

an upper tubular support connected to the lower end of said tubular string;

a retrieval tool supported from the lower end of said tubular support and extending downwardly therefrom;

an outer washover pipe supported from said tubular support in concentric relation about said retrieval tool and extending downwardly beyond the lower end of said retrieval tool to define an outer annulus between said washover pipe and said casing and an inner annulus between said washover pipe and said retrieval tool; said washover pipe being lowered into contact with soil and debris over said obstruction for removal of the soil and debris with fluid flowing downwardly through said outer annulus for entraining the soil and debris for flowing upwardly within said washover pipe and said tubular string for removal prior to engagement of said retrieval tool with said obstruction; and a port above the upper end of said retrieval tool at a location to provide fluid communication between said inner annulus and the bore of said tubular string, said upward flow of fluid with entrained soil and debris being permitted through said inner annulus and said port in said retrieval tool to said tubular string to bypass said retrieval tool.

2. A combined washover and retrieval device as set forth in claim 1 wherein:

said retrieval tool includes a sub on its upper end having said port therein, said sub having a closed end below said port to block upward flow of fluid through said retrieval tool.

3. A combined washover and retrieval device as set forth in claim 1 wherein:

said retrieval tool includes a sub threaded at its upper end to said tubular support, and said washover pipe is threaded at its upper end to said tubular support forms a shroud about said retrieval tool including said sub.

4. A combined washover and retrieval device as set forth in claim 1 wherein:

a check valve is mounted in said tubular string to prevent the downward flow of fluid from said tubular string through said retrieval tool when closed; and valve means on the tubular string above said check valve movable to an open position to allow the drainage of fluid from said tubular string upon raising of said washover and retrieval device from the well bore with said check valve closed.

5. A combined washover and retrieval tool as set forth in claim 1 wherein:

a check valve is mounted in said tubular string to prevent downward flow of fluid when closed; said tubular string having a discharge port in the wall of said tubular string above said check valve; and valve means for said port to permit fluid flow through said port when fluid is circulated downwardly through said tubular string.

6. A combined washover and retrieval device adapted to be connected to the lower end of a tubular string within a well bore for the removal of an obstruction within said well bore and comprising:

an outer casing lining said well bore;

an upper tubular support connected to the lower end of said tubular string;

a retrieval tool supported from the lower end of said tubular support and having a closure therein to block fluid flow through said tool;

an outer washover pipe supported from said tubular support in concentric relation about said retrieval tool and extending downwardly below said retrieval tool to define an outer annulus between said washover pipe and said casing and an inner annulus between said washover pipe and said retrieval tool;

said retrieval tool having a port therein at a location above said closure and providing fluid communication between said inner annulus and the bore of said tubular string, the upward flow of fluid and entrained soil and debris through said washover pipe passing through said inner annulus and port to bypass said retrieval tool.

7. The combined washover and retrieval device as set forth in claim 6 wherein:

a check valve is mounted on said tubular string to prevent the downward flow of fluid from said tubular string past said check valve; and valve means in the tubular string above said check valve allows the drainage of fluid from said tubular string upon raising of said washover and retrieval device from the well bore.

8. A method of removing sand and debris over an obstruction within a well bore for assisting connection of a retrieval tool to the obstruction for removal of the obstruction; said method comprising:

providing a tubular string within the well bore;

supporting a combined washover and retrieval device from the tubular string having a washover pipe extending concentrically about a retrieval tool with an inner annulus between the washover pipe and retrieval tool;

providing a port in said retrieval tool in fluid communication with said inner annulus;

lowering the washover and retrieval device from the lower end of the tubular string into a bore hole adjacent the obstruction;

circulating fluid downwardly in an outer annulus between the washover pipe and casing lining the bore hole for entraining soil and debris about said obstruction; and then circulating the fluid with entrained soil and debris upwardly through said inner annulus and through said port to the bore of said tubular string to bypass said retrieval tool for removal of said soil and debris.

9. A method as set forth in claim 8 further including the steps of:

continuing the fluid circulation during lowering of said device to a position in which the washover pipe is spaced from the obstruction; and connecting the retrieval tool to said obstruction while said washover pipe is spaced from said obstruction and during continuous washing of soil and debris atop the obstruction.

10. A combined washover and retrieval device adapted to be connected to the lower end of a tubular string for lowering within a well bore and comprising:

an outer casing lining said well bore;

an upper tubular support connected to the lower end of said tubular string;

a retrieval tool supported from the lower end of said tubular support and extending downwardly therefrom;

an outer washover pipe supported from said tubular support in concentric relation about said retrieval tool and extending downwardly beyond the lower end of said retrieval tool to define an outer annulus between said washover pipe and said casing and an inner annulus between said washover pipe and said retrieval tool; said washover pipe being lowered into contact with debris for removal of the debris with fluid flowing downwardly through said outer annulus for entraining the debris for flowing upwardly within said washover pipe and said tubular string for removal; and a port above the upper end of said retrieval tool at a location to provide fluid communication between said inner annulus and the bore of said tubular string, said upward flow of fluid with debris being permitted through said inner annulus and said port in said retrieval tool to said tubular string to bypass said retrieval tool.

* * * * *